United States Patent [19]

King, Sr. et al.

[11] Patent Number: 4,976,279

[45] Date of Patent: Dec. 11, 1990

[54] SELF-DRAINING BACKFLOW PREVENTION VALVE

[76] Inventors: Lloyd H. King, Sr., 5222 Green Farms Rd., Edina, Minn. 55436; Joseph A. King, 16261 S. Temple Dr., Minnetonka, Minn. 55343

[21] Appl. No.: 438,807

[22] Filed: Nov. 20, 1989

[51] Int. Cl.[5] ..... E03C 1/10

[52] U.S. Cl. ..... 137/107; 137/218; 137/512.3

[58] Field of Search ..... 137/218, 107, 512.3, 137/512.4

[56] References Cited

U.S. PATENT DOCUMENTS

| | | | |
|---|---|---|---|
| 2,646,063 | 7/1953 | Hayes . | |
| 2,997,054 | 8/1961 | Woodford . | |
| 3,023,767 | 3/1962 | Woodford . | |
| 3,155,107 | 11/1964 | Woodford | 137/218 |
| 3,171,423 | 3/1965 | Dillon . | |
| 3,183,924 | 5/1965 | Duchin . | |
| 3,868,962 | 3/1975 | Waterston . | |
| 4,658,852 | 4/1987 | Weingarten | 137/218 |
| 4,726,390 | 2/1988 | Franklin | 137/218 |

FOREIGN PATENT DOCUMENTS

| | | | |
|---|---|---|---|
| 1091498 | 10/1960 | Fed. Rep. of Germany | 137/218 |
| 875034 | 8/1961 | United Kingdom | 137/107 |

*Primary Examiner*—Stephen M. Hepperle

*Attorney, Agent, or Firm*—Jacobson & Johnson

[57] ABSTRACT

The present invention comprises an automatic self-draining backflow prevention valve having an internal cylindrical resilient sleeve that expands or contracts in response to water pressure to coact with a two way valve that provides for automatic self-draining of both the water faucet and the backflow prevention valve when the water faucet is shut off.

13 Claims, 3 Drawing Sheets

*Fig.-1* (PRIOR ART)
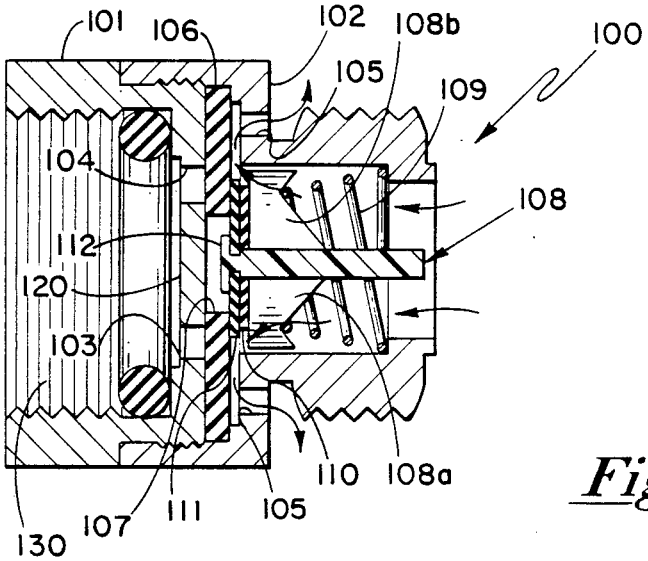
*Fig.-2* (PRIOR ART)
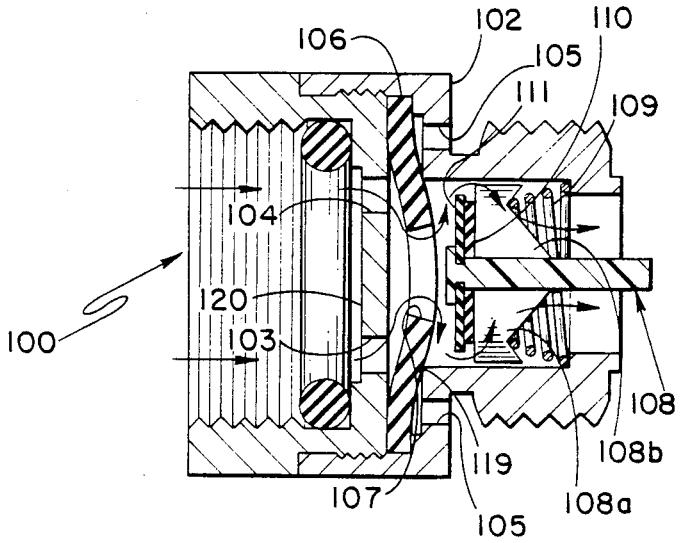
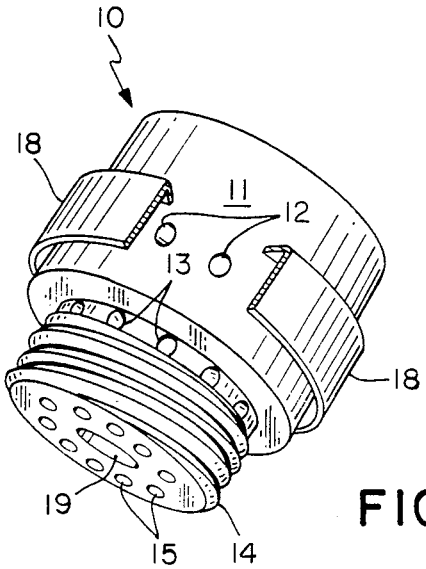
FIG. 3

SELF-DRAINING BACKFLOW PREVENTION VALVE

FIELD OF THE INVENTION

This invention relates generally to backflow prevention valves for attachment to water faucets on the exterior of buildings located in freezing climates and, more specifically, to a backflow prevention valve that automatically drains the water from the water faucet housing located between the interior shutoff valve and the spout on the exterior faucet to prevent freezing and rupturing of the water line and the faucet during freezing weather.

BACKGROUND OF THE INVENTION

One of the problems with outside water faucets on buildings located in cold climates is that they are often subject to freeze damage. In order to avoid freeze damage, the outside faucets are construted with internal shutoff valves that are located on the warmer interior of the building. The internal shutoff valve includes a valve and a valve seat for shutting off the flow of water in the portion of the water supply pipe located in the interior portion of the building. An interior located shutoff valve permits the water from the water supply to be shut off in the portion of the water supply pipe located on the interior of the building where the temperature remains above freezing. If no hoses or other attachments are connected to the faucet, shutting off the water supply inside the building also permits the water downstream of the internal shutoff valve seat to drain out through the faucet spout. Consequently, in the event of freezing conditions, there is not any water in the outside portion of the faucet to freeze and rupture the water pipes or the water faucet. However, freezing problems can occur with such prior art freeze-proof faucets, particularly, if there are hoses or backflow prevention devices connected to the water faucet. The present invention addresses the freezing problem when devices are attached to the water faucet.

In certain hookups the prior art backflow prevention valves do not permit an automatic self-draining of the faucet, i.e., the backflow prevention valves connected to the faucet spout do not automatically permit water to drain out of the faucet housing located between the outside spout of the faucet and the internal valve seat when the water pressure is shut off. Consequently, if the temperature drops below freezing and the faucet has not been drained, the water in the faucet may freeze and rupture the water pipe or the faucet.

In order to minimize the freeze damage to faucets and water pipes, some backflow prevention valves have been provided with a manual drain system so the water can be drained from the faucet. The present invention eliminates the need for a manual drain system when using backflow prevention valves by providing a backflow prevention valve that automatically drains the water in the faucet even though the faucet may be connected to a hose or the like.

DESCRIPTION OF THE PRIOR ART

The Hayes U.S. Pat. No. 2,646,063 shows a backflow prevention valve. The Hayes patent uses a perforated resilient diaphragm which permits water to flow in one direction. When the water is shut off, the diaphragm collapses back into the valve thereby preventing backflow of water into the tap.

The Woodford U.S. Pat. No. 2,997,054 shows a vacuum breaker device having a flexible diaphram 17 to prevent backflow. To drain the water in the Woodford device he partially unscrews his device to permit air to enter the faucet. Woodford uses a "L" shaped member to limit the necessary loosening of his device so that air can enter the faucet to permit water to drain from the drainage openings in his backflow device. The Woodford device requires a manual opening of an air vent to permit drainage of the water in the faucet.

The Woodford U.S. Pat. No. 3,033,767 shows a similar vacuum breaker valve without the manual means to limit the loosening of the valve.

The Dillion U.S. Pat. No. 3,171,433 shows an anti-siphon valve and backflow prevention valve which uses a disk that is resiliently held in the valve. In operation water can only flow in one direction past the disk.

The Duchen U.S. Pat. No. 3,183,934 shows a vacuum breaker valve that has a one-way check valve 44 to prevent backflow into the water supply. Duchen also shows a drain hole 68 but no mention is made as to how it functions as a drain hole and is closed off when water flows through his valve.

The Waterson U.S. Pat. No. 3,868,962 shows a backflow prevention valve which uses the pressure difference between the inlet and the outlet to open a relief valve to permit release of excess fluid pressure.

BRIEF SUMMARY OF THE INVENTION

Briefly, the present invention comprises a self-draining backflow prevention valve having an internal cylindrical resilient sleeve that expands or contracts in response to water pressure and coacts with a two way valve that provides for automatic self-draining of the water faucet and the backflow prevention valve when the water faucet is shut off.

BRIEF DESCRIPTION OF THE DRAWINGS

FIG. 1 is a cross sectional view of a prior art valve in the draining condition;

FIG. 2 is a cross sectional view of a prior art valve in the normal operating position;

FIG. 3 is a pictorial view of the backflow prevention valve;

DESCRIPTION OF ILLUSTRATED PRIOR ART

Figure 5:
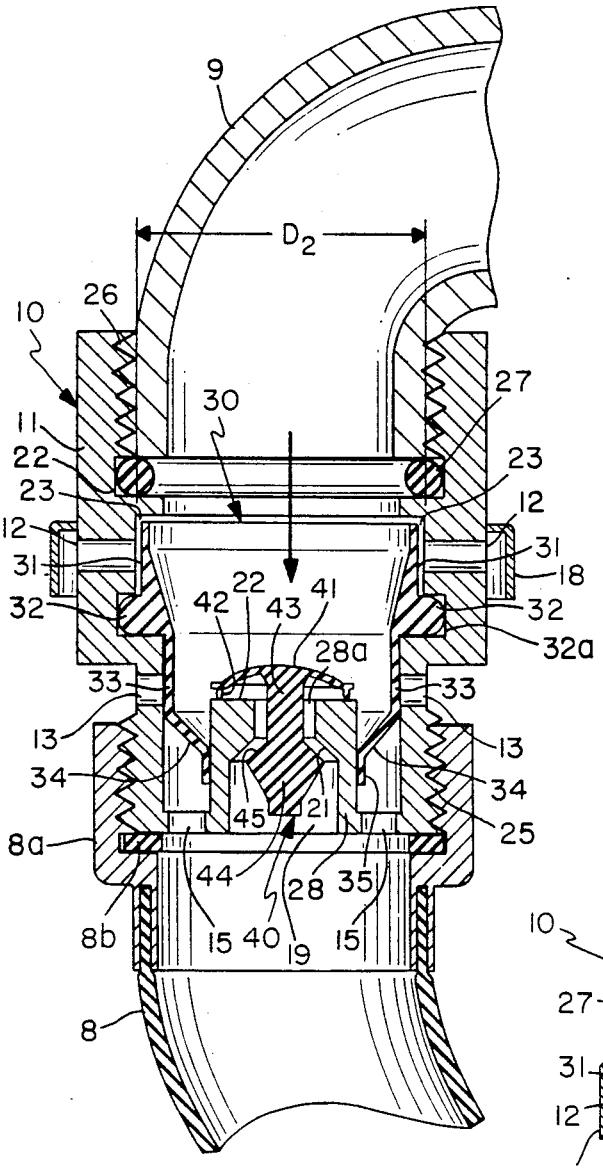
FIG. 5 shows our backflow preventing valve in the relaxed position with no water pressure on the inlet to the valve.

FIGS. 1 and 2 show a prior art one-way backflow prevention valve 100 having an inlet housing 101 for connection to a water faucet and an outlet housing 102 for connection to a garden hose. Backflow prevention valve 100 permits automatic self-draining of the water in outlet housing 102 when a hose is connected to outlet housing 102. Valve 100, however, does not permit self-draining of the water located in the water faucet connected to inlet housing 101.

In normal use the internal threads 130 in housing 101 connect inlet housing 101 to the external threads on a water tap or water faucet located on the exterior of a building. A central member 130 having openings 103 and 104 permits passage of water therethrough. Located immediately to the right of member 130 is an annular flexible sealing member 106 which covers openings 103 and 104. Member 106 has a central opening 107 which is covered by a flexible sealing member 111. The peripheral edge of sealing member 106 is pinched and firmly held between housing 101 and housing 102 while the central portion of member 106 is permitted to flex inward and outward in response to water pressure. Circular flexible sealing member 111 which is located over central opening 107 is resiliently held over opening 107 in member 106 by plunger-like member 108 which has a retaining head 112 and a compression spring 109. Located on one end of plunger 108 is a circular support area 110 that sandwiches flexible sealing member 111 against sealing member 106 to seal off the central opening 107 in member 106 (FIG. 1) and thus prevent backflow in valve 100.

To illustrate the one-way operation of the prior art backflow valve 100, reference should be made to FIG. 1 which shows valve 100 in the backflow prevention condition. In the backflow prevention condition water is prevented from flowing from housing 102 into housing 101 because member 111 seals the central opening 107 in sealing member 106 and sealing member 106 seals openings 104 and 103 in member 130. The arrow illustrates how water can drain from the outlet side of valve 100 through opening 105.

FIG. 2 shows valve 100 in the normal operating position with arrows indicating the direction of water flow. In the normal operating position water flows through openings 103 and 104 (indicated by the arrows). The water pressure also pushes the central portion of sealing member 106 to the right permitting water to flow through passage 107. The water pressure pushes sealing member 111 and plunger 108 to the right to permit water to flow around plunger 108 to permit water to discharge from outlet housing 102. Thus, the prior art valve 100 is a one-way valve that permits water to flow in only one direction. Back flow prevention valves such as these are particularly useful when one wants to avoid contaminating the source of water.

The feature of valve 100 that permits self-draining of outer housing 102 and a hose connected thereto is the peripherally spaced opening 105. FIG. 2 shows that when water pressure is turned on, sealing member 106 deflects towards the right, causing a portion of one face of sealing member 106 to contact circular edge 119 and seal off the discharge drain opening 105 thereby preventing water from being discharged through openings 105.

FIG. 1 shows (as indicated by the arrow) that when the water pressure at the inlet housing 101 is less than the outlet housing 102, the flexible sealing member 106, aided by spring 109 and plunger 108, retracts to the vertical position shown which uncovers discharge opening 105 to permit water to drain from outlet housing 102. While the prior art valve 100 permits water to automatically self-drain from outlet housing 102, it suffers the disadvantage that it does not permit water to automatically self-drain from the portion of the supply pipe located between the internal shutoff valve and the spout that attaches to housing 101. It is this particular region of the water supply system between inlet housing 101 and the internal shutoff valve which if not drained leads to problems of freezing and pipe damage. The present invention permits one to automatically self-drain the portions that are exposed to freezing conditions.

DESCRIPTION OF THE PREFERRED EMBODIMENT

Referring to FIG. 3 we show a pictorial view of our backflow prevention valve 10 that automatically self drains the portions of the water supply system that may be exposed to freezing temperatures. While our valve may be used with different liquids the operation will be described in relation to use on a water supply located on the interior of a building.

Backflow prevention valve 10 comprises a cylindrical housing 11 with a first set of circumferentially spaced openings 12 that permit air to enter into the water supply line during the draining process. Openings 12 are partially covered by an axially extending cylindrical skirt 18 that deflects water that may surge out of openings 12 as air begins to enter openings 12. Skirt 18 thereby prevents accidental spraying of a person standing by the faucet. Located on the lower portion of valve 10 is set of threads 14 for threading engagement to a hose or the like. Located on one end of valve 10 are a second set of circumferentially spaced openings 15 to permit passage of water through valve 10. Valve 10 includes a third circumferentially set of spaced water discharge opening 13 and a central water discharge opening 19.

Figure 4:
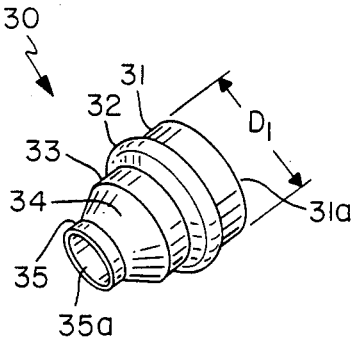
FIG. 4 shows a pictorial view of the resilient sleeve that is mounted in our valve.

FIG. 4 shows an inner and coaxial open ended resilient sleeve 30 that is located internally within valve 10 to direct the flow of water in the proper direction. Sleeve 30 comprises a series of annular bands that form a general conical shaped resilient sleeve that contracts and expands in response to the water pressure in the system. On one end of sleeve 30 is a cylindrical annular member or band section 31 of diameter D1. Next to cylindrical annular section 31 is an annular holding bead 32 that holds sleeve 30 in position within valve 10. Connected to bead 32 is a cylindrical annular member or band section 33 that connects to conical annular member or band section 34. Conical annular member 34 connects to cylindrical annular member or band section 35. Each of the sections are contiguously connected to the adjacent section to provide a one piece sleeve. An opening **35*a* is located one end of sleeve 30 and a similar opening 31*a* is located on the opposite end of sleeve 30. Bands 31, 33, 34, 35, and bead 32** thus cooperate to define a one piece resilient sleeve which is typically made of material such as rubber or the like.

In order to illustrate the operation of my automatic backflow prevention valve reference should be made to FIG. 5, FIG. 6, FIG. 7, and FIG. 8.

FIG. 5 illustrates my backflow prevention in the relaxed position with no water pressure on the inlet **31*a* to the backflow prevention valve 10**.

Figure 6:
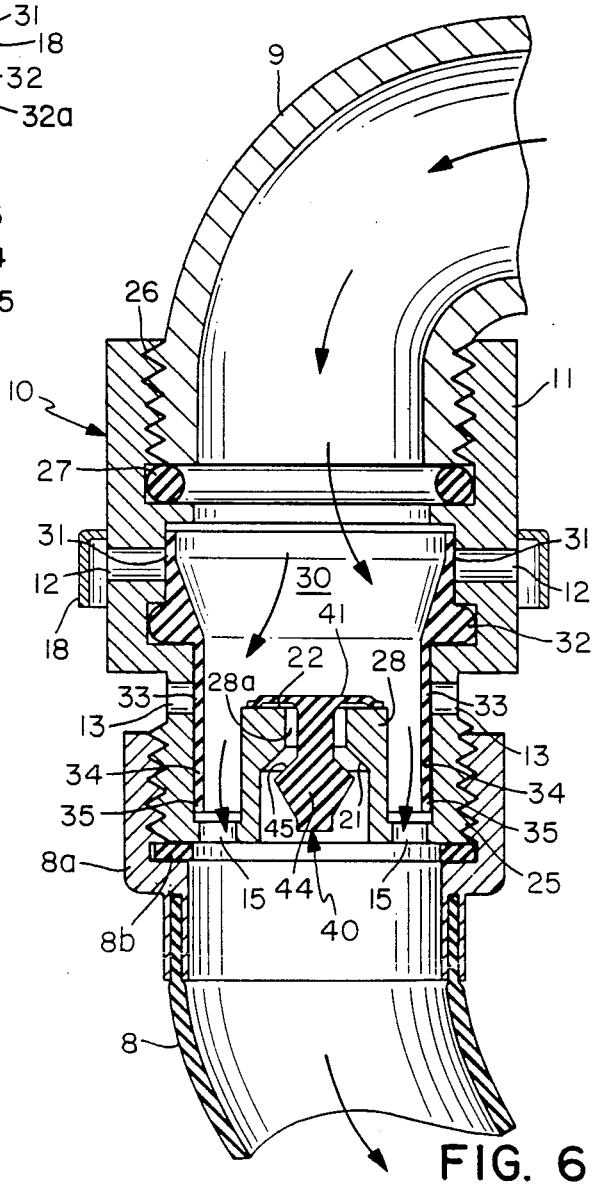
FIG. 6 shows our backflow prevention valve in the normal operating position.

FIG. 6 shows backflow prevention valve 10 in the normal operating position as water flows directly through backflow prevention valve 10 and into hose 8.

Figure 7:
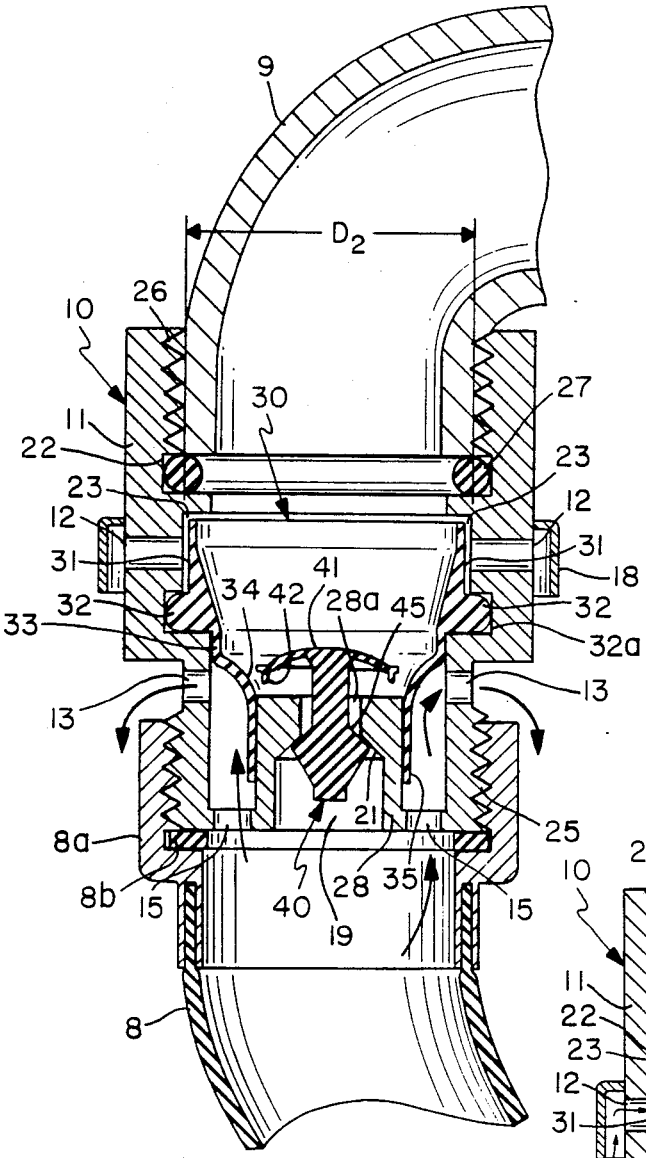
FIG. 7 shows our backflow prevention valve draining water from a hose.

FIG. 7 shows backflow prevention valve 10 draining water from a hose 8 connected to the backflow prevention valve 10.

Figure 8:
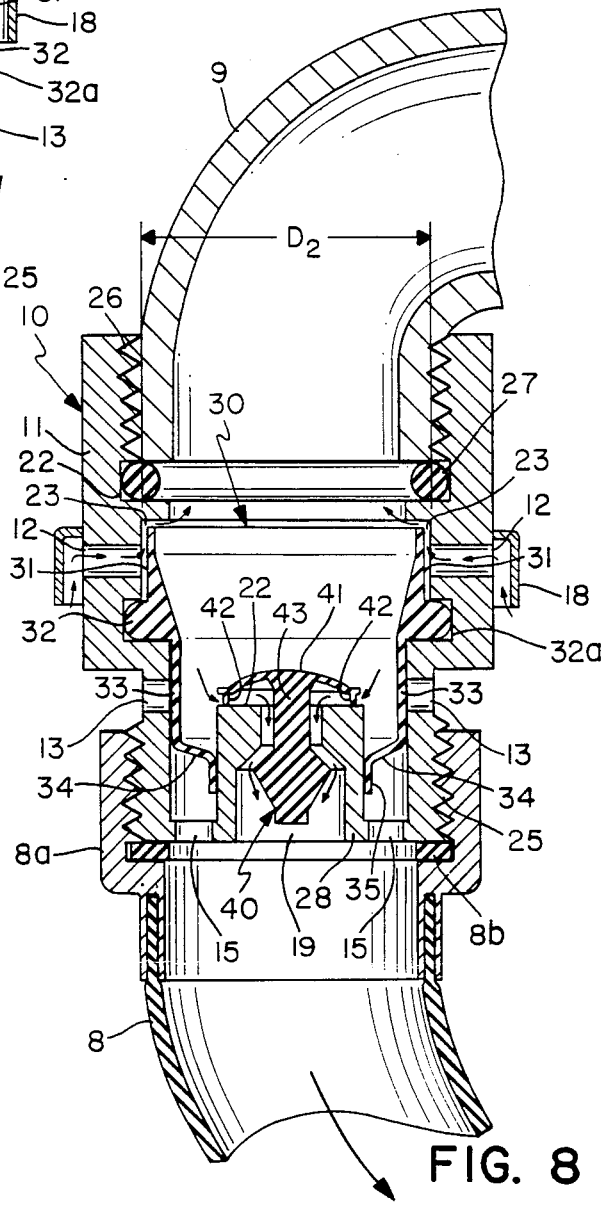
FIG. 8 shows our backflow prevention valve as it automatically drains the water from the faucet into a hose.

FIG. 8 shows backflow prevention valve 10 automatically draining the water from the faucet into hose 8.

Referring to FIG. 5 reference numeral 9 represents the spout or end of a water faucet housing that normally extends through the exterior wall of a building. One end of my backflow prevention valve 10 threadingly connects to faucet spout 9 through threads 26. An "O-Ring 27 fits in recess 22 and forms a water tight seal between housing 11 and spout 9. The threads 14 on the other end of backflow prevention valve 10 threadingly connect to threads 25 in a hose coupling 8*a* connected to hose 8. A rubber sealing ring 8*b* provides a water tight seal between the end of spout 9 and coupling 8*a*.

FIG. 5 illustrates the relaxed location of resilient sleeve 30 within the stepped cylindrical confines of cylindrical housing 11. Note, annular bead 32 fits into a cylindrical recess 32*a* to prevent sleeve 30 from being axially displaced within valve 10. Section 31 has an outside diameter designated by D1 which is slightly smaller than the inside diameter D2 of housing 11 to normally provide a cylindrical annular air gap 23 that permits air to enter spout 9 when the water pressure is shut off. Typically air gap 23 may be about 0.050 inches to 0.010 inches. In the normal or relaxed position of sleeve 30 section 33 extends over circumferential openings 13. The end band 35 fits snugly around the central hollow post 28 in housing 11 to prevent water from flowing upstream between post 28 and opening 35*a* in sleeve 30 but does not prevent water from flowing downstream around post 28 and through opening 15.

Located extending through hollow post 28 is a resilient two way valve 40. Valve 40 comprises a dome shaped head 41 with plurality of resilient tips 42 that normally hold head 41 in a spaced distance from surface 22 when no water pressure is present in spout 9. A stem 43 extends through opening 28*a* in post 28. Located on one end of stem 43 is a head 44 with a surface 45 that can form mating and sealing engagement with a conical surface 21 on the interior of post 28. Valve 40 is known in the art and is in U.S. Pat. No. 4,317,471.

To illustrate the normal flow operation of water flowing through backflow prevention valve 10 reference should be made to FIG. 6 which shows water (arrows) from faucet 9 flowing through housing 11 and into hose 8. Note, that the water pressure expands member 31 and holds annular member 31 over opening 12 to prevent water from flowing out openings 12. That is, in response to water pressure in spout 9 resilient band members 34 and 35 expand radially outward to permit water to flow through the annular opening between post 28 and the cylindrical opening 35*a* in sleeve 30. In addition the water pressure forces head 41 of two way valve 40 to seat against surface 22 to seal off the central region 28*a* of post 28. Thus in the normal operation mode as shown in FIG. 6 water flows directly through backflow prevention valve 10 and into hose 8.

Referring to FIG. 7 the drawing illustrates how sleeve 30 and valve 40 are displaced to prevent backflow by permitting water in hose 8 to drain out the side discharge openings 13. That is, with the water pressure shut off in the faucet the water pressure in hose 8 forces two way valve 40 to move upward and seat against annular seat 21 in post 28. Similarly, the water pressure forces annular member 33 and 34 radially inward thereby exposing circumferentially spaced drain opening 13. In the condition shown in FIG. 7 it is apparent that the water (indicated by arrows) in hose 8 is prevented from flowing back into the faucet 9 should the pressure in faucet 9 drop. That is with a loss of water pressure in faucet 9 water flows as indicated by arrows annular along the interior of housing 11 where it can be discharged through opening 13. Consequently, the water supply system connected to the faucet is protected from contamination.

FIG. 8 shows how the remaining water in faucet 9 is permitted to drain into hose 8 or passages 12. The arrows in passages 12 indicate air entering passages 12 to permit water to drain from the faucet. The lower arrows indicates the path that water drains in faucet 9. This residual water would be water that is not under pressure but is still present in faucet 9 after the internal valve is shut off. If this residual water were allowed to remain in faucet 9 it could freeze and break faucet 9. Note the air gap 23 permits air to enter through openings 12 so that the water can drain out. In addition the resiliency of legs 42 causes valve head 41 to move upward so water can drain from faucet 9 around valve 40 and into the hose 8. With the presence of an air passage 23 it permits the water remaining in faucet 9 to drain out through hose 8. Consequently, my backflow prevention valve prevents water from flowing back into the faucet under pressure surges and also permits any water in the faucet or the portion downstream of the internal shutoff valve to automatically self-drain once the water supply to faucet 9 is shut off.

We claim:

1. A device for preventing backflow of a liquid comprising:

a housing for attachment to a faucet to permit entry of a liquid under pressure into said housing, said housing including a liquid passage to permit flow of liquid therethrough, said housing including a drain passage to permit backflow liquid to drain from said housing, said housing including an air inlet passage to permit air to enter said housing so that liquid can be drained from a faucet attached to said device; and a resilient sleeve, said resilient sleeve having a first region for covering said air inlet passage to prevent liquid from flowing through said air inlet passage when liquid under pressure is supplied to said housing, said resilient sleeve having a second region for covering said drain passage to prevent liquid from flowing through said drain passage when liquid under pressure is supplied to said housing, said resilient sleeve having a third region that is expandable to permit liquid to flow through said sleeve when liquid under pressure is supplied to said housing, said third region contractible when the liquid under pressure loses pressure to permit said third region to contract and prevent backflow of liquid through said sleeve by directing liquid through said drain passage.

2. The device of claim 1 including automatic self-draining, said device including a two way valve located in said housing for automatically draining said housing when the liquid under pressure to the faucet is shut off to thereby permit liquid to drain from said faucet and said housing so that the user can prevent breaking of said device due to freezing of liquid in said device.

3. The device of claim 2 wherein said two way valve is made of a resilient material.

4. The device of claim 3 wherein said housing includes an annular recess and said resilient sleeve includes an annular bead for fitting in said annular recess to hereby hold said sleeve in position within said housing.

5. The device of claim 3 wherein said housing includes a deflector located in front of said air inlet passage to prevent liquid from being sprayed directly out of said air inlet passage.

6. The device of claim 3 wherein said first region comprises a first annular region having a diameter of D1 and an interior region of said housing adjacent to said first annular region has a diameter of D2 which is larger than D1 so that an annular air gap is provided between said resilient sleeve and said interior region of said housing to permit air to enter said housing when the liquid pressure is shut off to a faucet attached to said device.

7. The device of claim 6 wherein said air inlet passages are circumferentially spaced around said housing.

8. The device of claim 7 wherein said sleeve has an annular shape with a central opening there through.

9. The device of claim 8 wherein said drain passage comprises a plurality of openings circumferentially spaced around said housing.

10. The device of claim 9 wherein said housing includes a hollow post with said two way valve located in said hollow post to permit liquid in said housing to drain from said housing.

11. The device of claim 10 wherein said third region in said resilient sleeve includes an annular band that fits around said hollow post to prevent backflow of liquid between said hollow post and said resilient sleeve.

12. A water backflow prevention device to prevent backflow of water into the faucet if the water pressure to the faucet should be abruptly shut off and to automatically drain the device when the water pressure is shut off comprising:

a housing having means for attachment to the spout end of a faucet for supplying water under pressure from a pressurized water source, said housing having further means for attachment to a hose or the like to permit water under pressure to be directed from the faucet through a hose, said housing including an air inlet passage to permit air to enter said housing when the water under pressure losses it pressure, said housing including a drain passage to drain water from a hose if a condition occurs that produces a backflow in the hose; and a resilient member, said resilient member located in said housing, said resilient member having a first region for covering said air inlet passage to prevent liquid from flowing through said air inlet passage when water under pressure is supplied to said housing, said resilient member having a second region that normally covers said drain passage when water under pressure is supplied to said housing, said resilient member including an expandable annular region that expands radially to permit water to flow through said resilient member and contracts radially inward if the water under pressure in the housing should decrease to thereby seal off the housing to prevent water from flowing back into a supply of water connected to the faucet.

13. A device for preventing backflow of a liquid comprising:

a housing for attachment to a faucet to permit entry of a liquid under pressure into said housing, said housing including a liquid passage to permit flow of liquid therethrough, said housing including a drain passage to permit backflow liquid to drain from said housing, said housing including an air inlet passage to permit air to enter said housing when the liquid under pressure loses its pressure so that liquid can be drained from a faucet attached to said device; and a cylindrical resilient sleeve for radial contraction and expansion within said housing, said resilient sleeve having a first region for covering said air inlet passage to prevent liquid from flowing through said air inlet passage when liquid under pressure is supplied to said housing, said resilient sleeve having a second region for covering said drain passage to prevent liquid from flowing through said drain passage when liquid under pressure is supplied to said housing, said resilient sleeve having a third region that is expandable to permit liquid to flow through said resilient sleeve when liquid under pressure is supplied to said housing, said third region contractible when the liquid under pressure loses pressure to permit said third region to contract and prevent backflow of liquid through said sleeve by directing backflow liquid through said drain passage.

* * * * *